US007876903B2

(12) United States Patent
Sauk

(10) Patent No.: US 7,876,903 B2
(45) Date of Patent: Jan. 25, 2011

(54) METHOD AND APPARATUS FOR CREATING A MULTI-DIMENSIONAL COMMUNICATION SPACE FOR USE IN A BINAURAL AUDIO SYSTEM

(75) Inventor: Paul L. Sauk, West Grove, PA (US)

(73) Assignee: Harris Corporation, Melbourne, FL (US)

( * ) Notice: Subject to any disclaimer, the term of this patent is extended or adjusted under 35 U.S.C. 154(b) by 1236 days.

(21) Appl. No.: 11/482,326

(22) Filed: Jul. 7, 2006

(65) Prior Publication Data

US 2008/0008342 A1 Jan. 10, 2008

(51) Int. Cl.
*H04R 5/00* (2006.01)
*H04R 5/02* (2006.01)

(52) U.S. Cl. ..... 381/17; 381/310

(58) Field of Classification Search ..... 700/94; 381/17, 18, 309, 310, 19–23, 74
See application file for complete search history.

(56) References Cited

U.S. PATENT DOCUMENTS

| | | | | |
|---|---|---|---|---|
| 4,081,606 | A | 3/1978 | Gerzon | |
| 4,086,433 | A | 4/1978 | Gerzon | |
| 5,596,644 | A | 1/1997 | Abel et al. | |
| 5,844,816 | A | 12/1998 | Inanaga et al. | |
| 6,021,206 | A * | 2/2000 | McGrath | 381/310 |
| 6,259,795 | B1 | 7/2001 | McGrath | |
| 6,370,256 | B1 | 4/2002 | McGrath | |
| 6,845,338 | B1 | 1/2005 | Willins et al. | |
| 6,961,439 | B2 | 11/2005 | Ballas | |
| 7,706,543 | B2 * | 4/2010 | Daniel | 381/17 |
| 2005/0198193 | A1 | 9/2005 | Halme | |

FOREIGN PATENT DOCUMENTS

| | | |
|---|---|---|
| WO | WO-0155833 | 8/2001 |
| WO | WO-02082860 | 10/2002 |

OTHER PUBLICATIONS

Amatriain et al., "Transmitting Audio Content as Sound Objects", AES 22nd International Conference on Virtual, Synthetic and Entertainment Audio, 2002, 11 pages.*

Vaananen et al., "Encoding and Rendering of Perceptual Sound Scenes in the Carrouso Project", AES 2nd International Conference on Virtual, Synthetic and Entertainment Audio, 2002, 9 pages.*

(Continued)

*Primary Examiner*—Ping Lee
(74) *Attorney, Agent, or Firm*—Fox Rothschild, LLP; Robert J. Sacco

(57) ABSTRACT

Method and apparatus for producing, combining, and customizing virtual sound environments. A binaural sound system (400) includes a transceiver (492) configured for receiving a signal (600) containing at least a first type of information and a second type of information. The first type of information includes enunciated data (602). The enunciated data specifies certain information intended to be audibly enunciated to a user. The second type of information comprises first type of metadata (604-1) and a second type of metadata (604-2). The first type of metadata includes information which identifies a characteristic of the enunciated data exclusive of spatial position information. The second type of metadata identifies a spatial position information associated with the enunciated data.

30 Claims, 6 Drawing Sheets

OTHER PUBLICATIONS

Sauk, Paul., et al., "Creating a Multi-Dimensional Communication Space to Improve the Effectiveness of 3-D Audio". Military Communications Conference, 2007. MILCOM 2007. IEEE, IEEE, Piscataway, NJ, USA, Oct. 29, 2007, pp. 1-7; XP031232723; ISBN: 978-1-4244-1512-0.
Hollier, M.P., et al., "Spatial Audio Technology for Telepresence". BT Technology Journal, Springer, Dordrecht, NL, vol. 15, No. 4, Oct. 1, 1997, pp. 33-41, XP000722032; ISSN: 1358-3948; pp. 33-39.
Faller, C. et al., "Efficient representation of spatial audio using perceptual parameterization," Proc. IEEE Workshop on Applications of Signal Processing to Audio and Acoustics (WASPAA '01), New Paltz, NY, 2001.
Keating, D. "The generation of virtual acoustic environments for blind people," Proc. 1st Euro. Conf. Disability Virtual Reality & Assoc Tech., Maidenhead, UK, pp. 201-207 1996.
Moller, H. "Fundamentals of binaural technology," Applied Acoustics, vol. 36, n 3-4, 1992, abstract only.
Karjalainen, M., et al., "Head-tracking and subject positioning using binaural headset microphones and common modulation anchor sources," International Conf. on Acoustics, Speech and Signal Processing, vol. IV, pp. 101-104, 2004.
Tikander, M. "Sound quality of an augmented reality audio headset," Proc. of the 8th Int. Conf. on Digital Audio Effects (DAFx '05), pp. 1-4, Madrid, Spain, 2005.
Noisternig, M., et al., "A 3D real time rendering engine for binaural sound reproduction," Proc. of the 2003 International Conf. on Auditory Display, pp. 107-110, 2003.
Suzuki, K. et al., "Monolothically integrated resonator microoptic gyro on silica planar lightwave circuit," Journal of Lightwave Technology, vol. 18, No. 1, pp. 66-72, 2000.
Hollier, M. et al., "Spatial audio technology for telepresence," BT Technology Journal, vol. 15, No. 4, pp. 33-41, 1997.
Cunningham, B. "Applications of virtual auditory displays," Proc. of the 20th Annual International Conf. of the IEEE Engineering in Medicine and Biology Society, vol. 20, No. 3, pp. 1105-1108, 1998.
Gerzon, M. "Surround Sound Psychoacoustics," Wireless World, vol. 80, Dec. 1974.
Begault, D. "3-D sound for virtual reality and multimedia," Hanover, MD, NASA Center for AeroSpace Information, pp. 53-54, Apr. 2000.
Zotkin, D., et al. "Creation of Virtual Auditory Spaces". Article appears in Acoustics, Speech and Signal Processing, 2002. Proceedings. ( ICASSP '02) IEEE Conference. Orlando, Fla. vol. 2, pp. 2113-2116.
Duraiswami, R. et al., "Interpolation and range extrapolation of HRTFs," International Conf. on Acoustics, Speech, and Signal Processing, vol. IV, pp. 45-48, 2004.
Biedermann, I., et al., "Reproduction of Surround Sound in Headphones," Faculty of Engineering and Science, Aalborg University, Group 960, Dec. 2004.
Kan, A., et al., "Mobile Spatial Audio Communication System", Proceedings of ICAD 04-Tenth Meeting of the Int'l Conf. on Auditory Display, Sydney, AU, Jul. 6-9, 2004.
Harbluk, et al., "The Impact of Cognitive Distraction on Driver Visual Behaviour and Vehicle Control", Transport Canada, Feb. 2002.

* cited by examiner

METHOD AND APPARATUS FOR CREATING A MULTI-DIMENSIONAL COMMUNICATION SPACE FOR USE IN A BINAURAL AUDIO SYSTEM

BACKGROUND OF THE INVENTION

1. Statement of the Technical Field

The inventive arrangements relate to the field of audio processing and presentation and, in particular, to combining and customizing multiple audio environments to give the user a preferred illusion of sound (or sounds) located in a three dimensional space surrounding the listener.

2. Description of the Related Art

Binaural audio is sound that is processed to provide the listener with a three dimensional virtual audio environment. This type of audio allows the listener to be virtually immersed into any environment to simulate a more realistic experience. Having binaural sound emanating from different spatial locations outside the listener's head is different from stereophonic sound and it is different from monophonic audio.

Binaural sound can be provided to a listener either by speakers fixed in a room or by a speaker fixed to each ear of the listener. Providing a specific binaural sound to each ear using a set of room speakers is difficult because of acoustic crosstalk and because the listener must remain fixed relative to the speakers. Additionally, the binaural sound will not be dependent on the position or rotation of the listener's head. The use of headphones takes advantage of minimizing acoustic crosstalk and the fixed distance between the listener's ear and corresponding speaker in the headphone.

Under ordinary circumstances, the sound arriving at each eardrum of a person undergoes multiple changes that provide the listener's brain with information regarding the location of the sound source. Some of the changes are caused by the human torso, the head, the ear pinna, and the ear canal. Collectively, these changes are called the Head Related Transfer Function (HRTF). The HRTF is typically a function of both frequency and relative orientation between the head and the source of the sound. The effect of distance usually results in amplitude attenuation proportional to the distance between the sound source and the listener. The differences in the amplitude and the time-of-arrival of sound waves at the left and right ears, referred to as the interaural intensity difference (IID) and the interaural time difference (ITD), respectively, provide important cues for audibly locating the sound source. Spectral shaping and attenuation of the sound wave also provide important cues used by the listener to identify whether a source is in front of or in back of a listener.

Another filter sometimes used in binaural systems is a Binaural Room Impulse Response (BRIR). The BRIR includes information about all acoustical properties of a room, including the position and orientation of the sound source, the listener, the room dimensions, the wall's reflective properties, etc. Thus, depending on the size, shape, and wall material of a room, the sound source located at one end of the room has different sound properties when heard by a listener at the other end of the room. An example of this technology is provided in most sound systems that are purchased today. These systems have several different sound effects to give the listener the feeling of sitting in an auditorium, a stadium, an inside theater, an outside theater, etc. Research has been conducted to demonstrate the capability derived from BRIR to give the listener the perceived effect of sound bouncing off walls of differently shaped rooms.

Conventional binaural systems have been proposed which simulate some of these changes that occur to sound as it arrives at the human ear from a remote source. Some of these systems are directed toward improving the filtering performance of the HRTF. The term "filter" as used herein refers to devices which perform an operation equivalent to convolving a time-domain signal with an impulse response. Similarly, the term "filtering" and the like as used here refer to processes which apply such a filter to a time-domain signal. Considerable computational resources are required to implement accurate HRTFs because they are very complex functions of direction and frequency. The overall design of the binaural audio system is very important to reduce implementation costs, improve sound feed-back rates, and to implement practical binaural sound fields which may include many sound sources.

At the highest level, a binaural system typically consists of three parts. The first part is the receiver. The receiver is generally designed to receive a monophonic radio frequency (RF) signal containing audio information, along with the metadata for that audio information. For example, the metadata typically includes spatial location information of the source of the particular audio information. This spatial location information can then be used to produce a binaural audio signal that simulates the desired spatial location of the source. A processor receives this metadata from the receiver as well as data from the listener's head-tracking apparatus. The processor uses this information to generate the audio that will be heard by each ear. Finally, the left and right audio is sent to a sound producer that can either be implemented with floor speakers positioned around a listener or with a headphone that places speakers next to each ear of a listener. The floor speakers have the disadvantage of having the listener fixed in position to hear three-dimensional (3-D) binaural sound. However, a headphone allows the listener to move freely while the processor monitors his movement and head position.

Most efforts toward improving binaural systems have focused on improving the fidelity of the binaural sound, increasing the speed of the binaural sound processor, or increasing the number of possible listeners. However, these efforts have tended to focus on the process for simulating a virtual audio environment. In contrast, few efforts have been directed to innovative applications for actually putting such binaural audio information to practical use.

SUMMARY OF THE INVENTION

The invention concerns a method and apparatus for producing, combining, and customizing virtual sound environments to provide the user with understandable information regarding their surroundings. A binaural sound system includes a receiver configured for receiving a signal containing at least a first type of information and a second type of information. The first type of information includes enunciated data. The enunciated data specifies certain information intended to be audibly enunciated to a user. The second type of information comprises first type of metadata and a second type of metadata. The first type of metadata includes information which identifies a characteristic of the enunciated data exclusive of spatial position information. The second type of metadata identifies spatial position information associated with the enunciated data. The binaural sound system also includes an audio processing system responsive to the signal. The audio processing system is configured for audibly reproducing the enunciated data to the user in accordance with a predetermined audio enhancement based on the first metadata, the second metadata or both.

The method of the invention includes a number of steps. The method can begin by generating one or more signals containing at least a first type of information and a second type of information. The first type of information includes enunciated data which specifies certain information intended to be audibly enunciated to a user. The second type of information includes at least a first type of metadata. The first type of metadata includes information which identifies a characteristic of the enunciated data exclusive of spatial position information used for identifying a location of a source (actual or virtual) of the enunciated data. The method also includes audibly communicating the enunciated data to the user in accordance with a predetermined audio enhancement which is based on the first type of metadata. The second type of information also includes a second type of metadata which identifies spatial position information associated with the enunciated data. This spatial position information is used for creating a 3-D binaural audio.

According to one aspect of the invention, the method includes the step of defining a plurality of binaural audio environments. According to one aspect, the predetermined audio enhancement include the step of selectively including the enunciated data in a selected one of the binaural audio environments only if the first metadata indicates that the enunciated data is associated with a particular one of the plurality of binaural environments. According to another aspect of the invention, the predetermined audio enhancement also includes establishing a plurality of user groups. In that case, the enunciated data is selectively included in a particular one of the plurality of binaural audio environment only if the enunciated data originated with a member of a predetermined one of the user groups.

Further, the predetermined audio enhancement can include selecting an audio reproduction format based on a source of the enunciated data as specified by the first metadata. For example, in an embodiment of the invention, the audio reproduction format is selected from the group consisting of monophonic audio, stereophonic audio, and a predetermined one of the plurality of binaural audio environments. Further still, the method can also includes defining a plurality of information relevance levels. Given the foregoing arrangement, the predetermined audio enhancement comprises selectively applying the audio reproduction format in accordance with a particular relevance level specified by the metadata. For example, a relevance level of enunciated data can be determined based on an identity of a source of the enunciated data. According to another aspect of the invention, the method includes selecting the predetermined audio enhancement to include selectively muting the information intended to be audibly enunciated to the user.

According to another aspect of the invention, the method further includes modifying the enunciated data with at least one of a BRIR filter and a reverb filter responsive to the second metadata. In this regard, the method can include selecting at least one of the BRIR and the reverb filter in accordance with a relative spatial distance of the user with respect to a remote location associated with a source of the enunciated data.

It should be understood that "enunciated data" as used herein will include a wide variety of different types of audio information that is available for presentation to a user. For example, the various types of enunciated data include live voice data as generated by a person, data which specifies one or more words which are then synthesized or machine reproduced for a user. Such synthesized or machine reproduction can include generating one or more words using stored audio data as specified by the enunciated data. It should also be understood that the term enunciated data as used herein includes data which specifies one or more different types of audio tones which are audibly reproduced for a user.

Finally, the method is not limited to generating enunciated data as a result of human speech. The method also advantageously includes automatically generating the one or more signals for generating enunciated data in response to a control signal. For example, the control signal can advantageously specify the occurrence of a predetermined condition. In one embodiment, the method includes automatically generating the control signal in response to a sensor disposed within a tactical environment.

DETAILED DESCRIPTION OF THE PREFERRED EMBODIMENTS

As a result of multi-axis gyroscopes becoming smaller, more accurate, and more rugged, a head-tracking means can be placed within a listener's headphone to provide a binaural audio system with the orientation of the listener's head. This head-tracking information will be processed to alter the sound arriving at the listener's ears so that the listener can hear and locate sounds in a virtual 3-D environment. Different binaural audio systems can have different characteristics. For example, in a binaural audio system virtual sounds can be made to either remain fixed relative to the listener's head, or can remain fixed relative to their real-world environment regardless of the rotation or orientation of the listener's head. These concepts are explained in further detail in relation to FIGS. 1-3.

Figure 1:
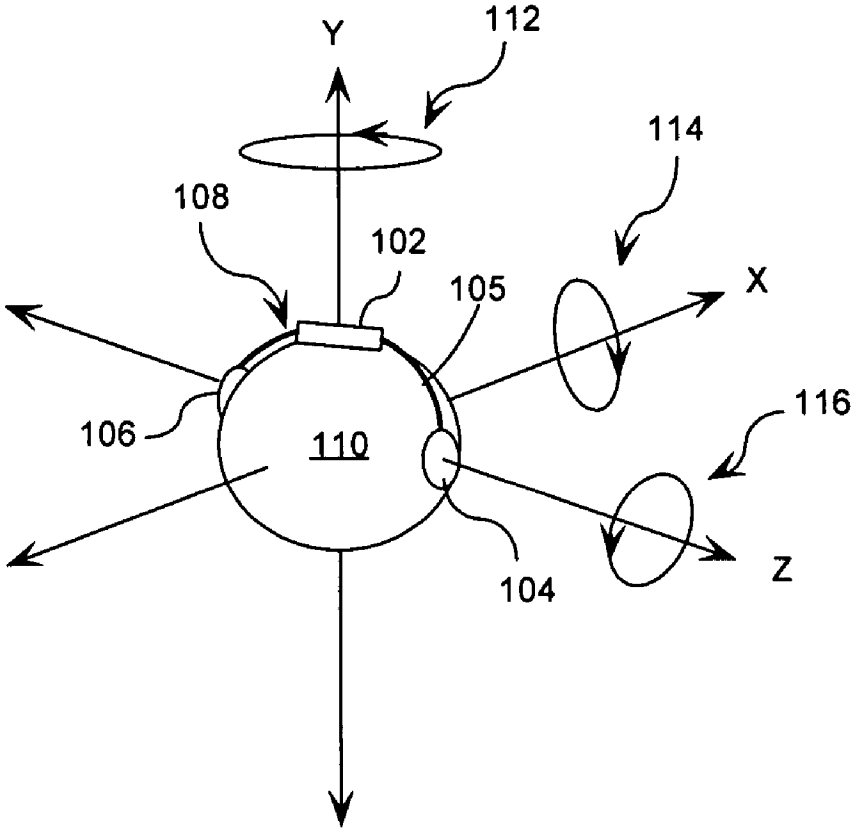
FIG. 1 is schematic diagram that is useful for understanding the various orientations of a human head that can affect an auditory response in a binaural system.

FIG. 1 illustrates the various head rotations and position of a listener's head 110. The axes, X, Y, and Z define the position of the listener's head 110. The head rotation about the X axis is defined as roll 114, the head rotation about the Y axis is defined as yaw 112, and the head rotation about the Z axis is defined as pitch 116. Yaw has also been defined in other literature as azimuth and pitch and has also been defined in other literature as elevation. The head-tracking apparatus 102 housed in the headphone 108 can be any means that provides information regarding the yaw, pitch, roll (orientation) and position of the listener's head 110 to the sound processor. For example, a three-axis gyroscope can be used for determining orientation, and a GPS unit can be used for determining position. The information obtained is provided to a binaural audio processing system.

The head tracking apparatus 102 can be mounted on a headphone frame 105. Speakers 104 and 106 can also be attached to the headphone frame 105. In this way, the headphones are positioned close to each ear of the listener's head 110. The headphone frame 105 is mounted on the listener's head 110 and moves as the head moves. Of course, other arrangements are also possible. For example, any conventional means can be used for attaching the speakers to the head 110. In this regard it will be understood the system can be implemented with ear plugs, headphones, or speakers positioned further away from the ears.

Figure 2B:
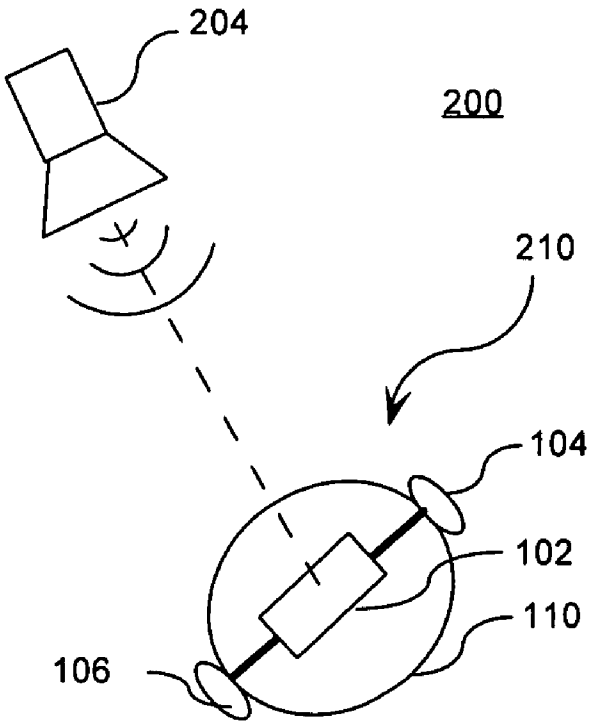
FIG. 2 is a schematic diagram that is useful for understanding different types of binaural systems.
Figure 2A:
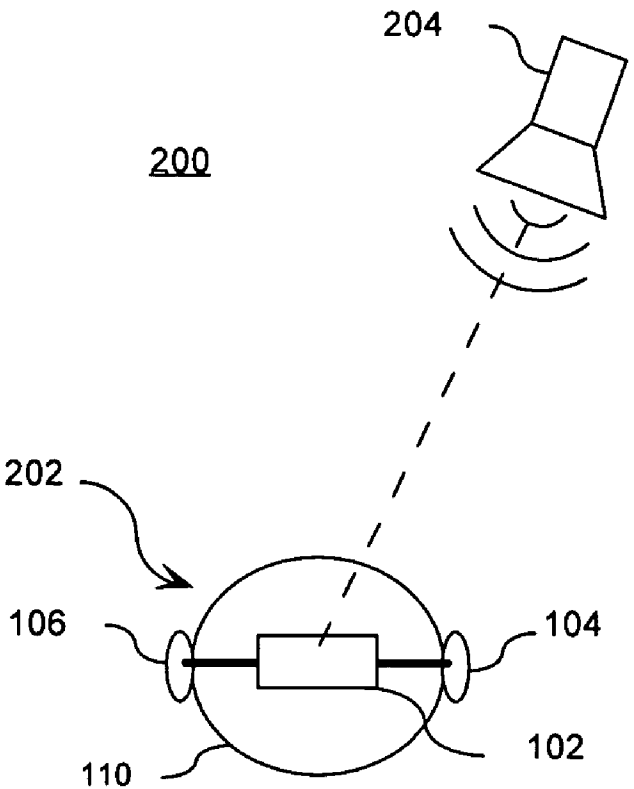

FIGS. 2 and 3 illustrate the difference between a head-fixed binaural sound environment 200 and a world-fixed binaural sound environment 250. In a head-fixed environment 200, the binaural sound appears to remain fixed relative the listener's head 11. Comparing FIGS. 2A and 2B, it can be observed that when the listener's head 110 is rotated about the Y axis from head orientation 202 to head orientation 210, the sound source 204 will move with the listener's head rotation. The binaural sound environment provided to the listener's ears with right speaker 104 and with left speaker 106 would not change in decibel level or quality even if the position of the sound source 204 were to change its real-world position or if the listener's head 110 were to move relative to the position of the sound source 204.

Figure 3B:
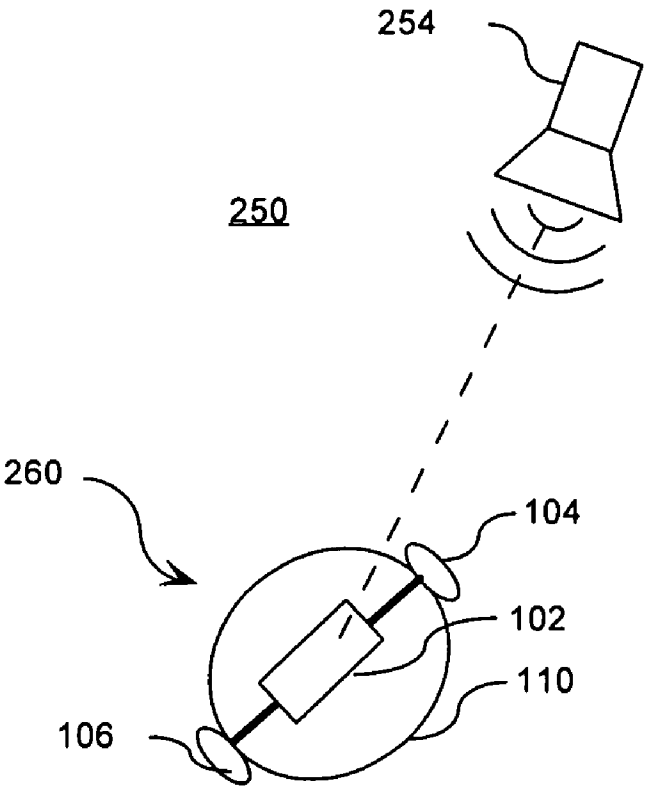
FIG. 3 is a schematic diagram that is useful for understanding different types of binaural systems.
Figure 3A:
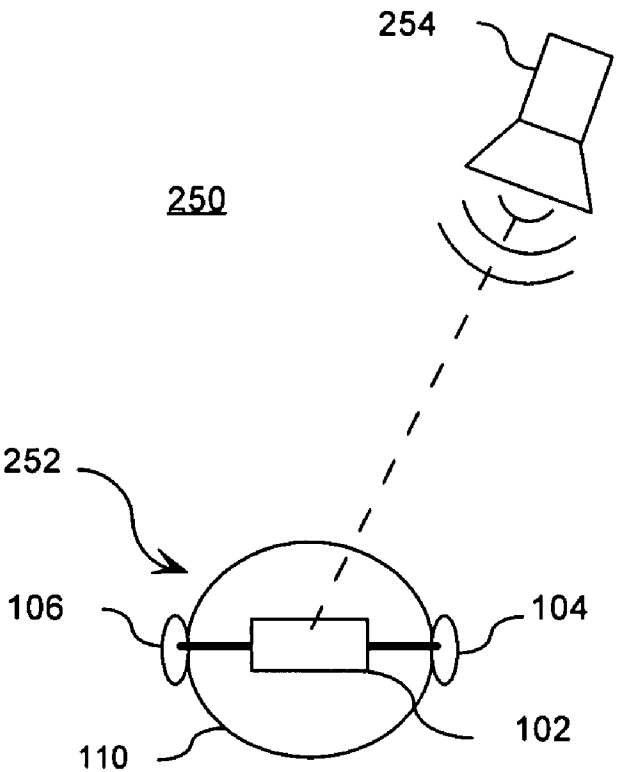

Conversely, FIGS. 3A and 3B illustrate the case of a world-fixed binaural sound environment 250. In the world-fixed binaural sound environment 250, the head 110 rotates about the Y axis from the head orientation 252 to the head orientation 260. However, it can be observed in FIGS. 3A and 3B that the sound source 254 does not appear to the listener to change its virtual position. The binaural sound environment provided to the listener's ears with right speaker 104 and with left speaker 106 will change in decibel level and/or quality as the real-world position of the listener's head 110 moves or changes orientation relative to the position of the sound source 204. It is contemplated that the various embodiments of the invention disclosed herein will advantageously make use of a world-fixed binaural sound environment. However, it will be appreciated that the invention is not limited in this regard, and there are some instances where a head-fixed binaural sound environment can also be used. The desirability of using a particular environment in each case will become apparent based on the detailed description of the invention that follows.

Figure 4:
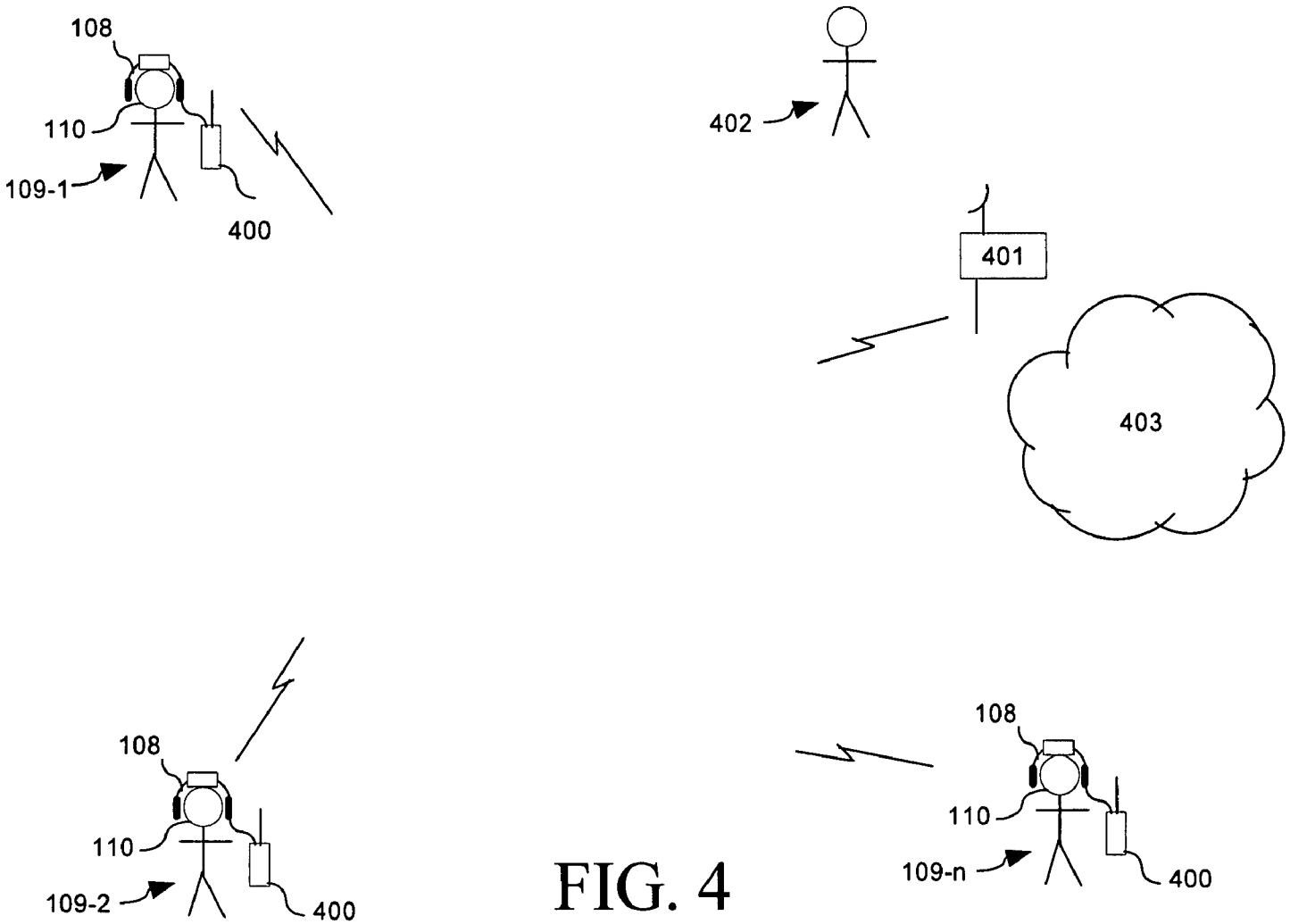
FIG. 4 is a system overview diagram that is useful for understanding the arrangement and the operation of a binaural sound system as disclosed herein.

FIG. 4 is a system overview diagram that is useful for understanding an arrangement of operation of a binaural sound system as disclosed herein. A plurality of users 109-1, 109-2, . . . **109-*n* are each equipped with a binaural sound system (BSS) 400. Each BSS 400 is connected to a set of headphones 108 or other sound reproducing device. The headphones 108 are preferably worn on the user's head 110. The BSS can be integrated with the headset 108. However, size and weight considerations can make it more convenient to integrate the BSS into a handheld or man-pack radio system. Each BSS 400 advantageously includes radio transceiver circuitry which permits the BSS 400 to send and receive RF signals to other BSS 400** in accordance with a predetermined radio transmission protocol. The exact nature of the radio transmission protocol is unimportant provided that it accommodates transmission of the various types of data as hereinafter described.

According to an embodiment of the invention, the BSS 400 units can be designed to operate in conjunction with one or more remote sensing devices 401. The remote sensing devices 401 can be designed to provide various forms of sensing which will be discussed in greater detail below. The sensing device(s) 401 communicate directly or indirectly with the BSS 400 using the predetermined radio transmission protocol. In this regard, it will be understood that the radio transmission protocol can include the use of terrestrial or space-based repeater devices and communication services.

Figure 5:
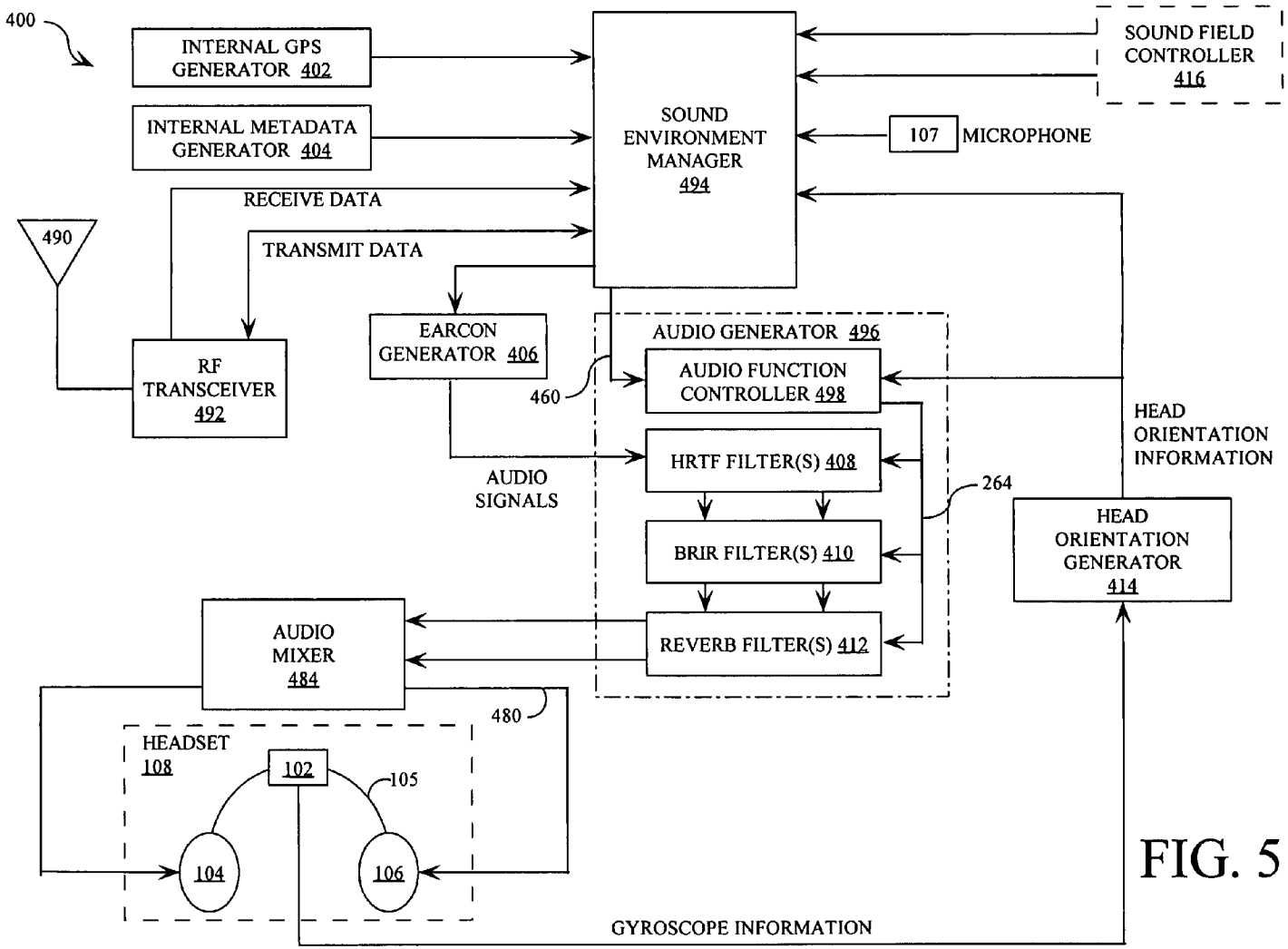
FIG. 5 is a block diagram of a binaural sound system that can be used to implement a multidimensional communication.

FIG. 5 is a block diagram that is useful for understanding the binaural sound system 400. Those skilled in the art will appreciate that the architecture shown in FIG. 5 is not intended to limit the invention but is merely presented as one possible arrangement of a system for achieving the results described herein. Any other system architecture can also be used provided that it offers capabilities similar to those described herein.

Figure 6A:
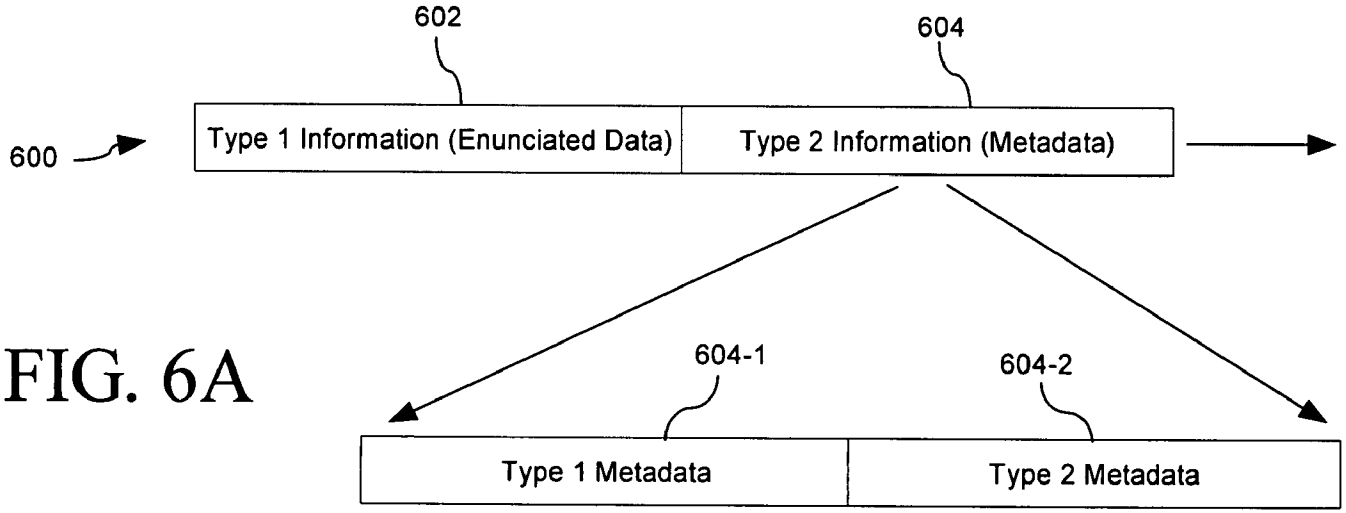
FIG. 6 is a diagram that is useful for understanding an arrangement of a signal containing enunciated data and metadata for a binaural sound system.
Figure 6B:
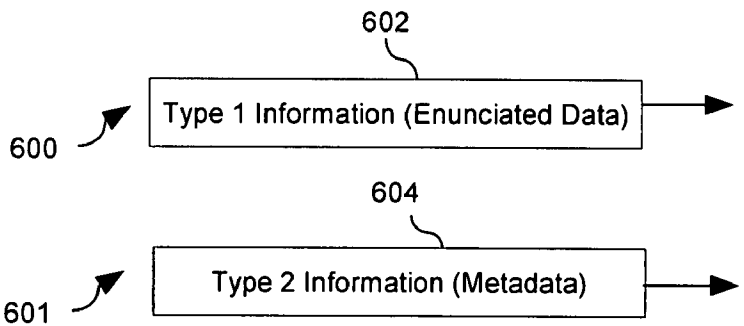

It can be observed in FIG. 5 that the BSS 400 includes a single or multi-channel RF transceiver 492. The RF transceiver can include hardware and/or software for implementing the predetermined radio transmission protocol described above. The predetermined radio transmission protocol is advantageously selected to communicate at least one signal 600 that has at least two types of information as shown in FIG. 6. The first type of information includes enunciated data 602. The enunciated data 602 specifies certain information intended to be audibly enunciated to a user 109-1, 109-2, . . . **109-*n*. The second type of information is metadata 604. FIG. 6A illustrates that the first type of information 602 and the second type of information 604 can be sent serially as part of a single data stream in signal 600. As an alternative, FIG. 6B illustrates that the first type of information 602 and the second type of information 604 can be sent in parallel as part of two separate data streams in signals 600, 601. For example, the two separate signals 600, 601 in FIG. 6**B can be transmitted on separate frequencies. Those skilled in the art will appreciate that the particular transmission protocol selected is not critical to the invention.

Regardless of the transmission protocol used, the metadata 604 includes one or more various types of data. For example such data in FIG. 6 is shown to include first type metadata 604-1 and second type metadata 604-2. However, the invention is not limited in this regard and more or fewer different types of metadata can be communicated. Regardless of the exact number of different types of metadata, it should be understood that the reference to different types of metadata herein generally refers to separate data elements which specify different kinds of useful information which relates in some way or has significance with regard to the enunciated data 602. In an embodiment of the invention, at least a first type of metadata 604-1 will includes information that identifies a characteristic of the enunciated data 602 exclusive of spatial position information used for creating a 3-D binaural effect. For example, the first type of metadata can specify a user group or individual to which the communication belongs, data that specifies the particular type of enunciated data being communicated, data that specifies a type of alert or a type of warning to which the enunciated data pertains, data that differentiates between enunciated data from a human versus machine source, authentication data, and so on. Notably, the first type of metadata can also include certain types of spatial position information that is not used for creating a 3-D binaural audio effect. For example, first type metadata 604-1 includes information that defines a limited geographic area used to identify a location of selected users who are intended to receive certain enunciated data 602. Such information is used to determine which users will receive enunciated audio, not to create a 3-D binaural audio effect or define a location in a binaural audio environment.

The second type of metadata 604-2 identifies spatial position information associated with the enunciated data that is used to create a 3-D binaural audio effect. For example, the spatial position information can include one or more of the following: a real world location of a source of the enunciated data, a virtual or apparent location of a source of enunciated data, a real world location of a target, and/or a real world location of a destination. Also, it should be understood that a real world location and/or a virtual location can optionally include an altitude of the source or apparent source of enunciated data. The purpose of these different types of metadata will be discussed in more detail below.

Referring again to FIG. 5, it can be observed that the radio frequency (RF) signal(s) 600, 601, containing the enunciated data (602) and the metadata (604) is received by each user's BSS 400. The RF signal is received by antenna 490 which is coupled to RF transceiver 492. RF transceiver provides conventional single or multi-channel RF transceiver functions such as RF filtering, amplification, IF filtering, down-conversion, and demodulation. Such functions are well known to those skilled in the art and will not be described here in detail. The RF transceiver 492 also advantageously provides encryption and decryption functions so as to facilitate information secure communications. Finally, the RF transceiver 492 also decodes the RF signal by separating the enunciated data 602 and the metadata 604. This information is then sent to the sound environment manager 494. For example, the enunciated data 602 and the metadata 604 can be communicated to the sound environment manager 494 in a parallel or serial format.

The sound environment manager 494 can be implemented by means of a general purpose computer or microprocessor programmed with a suitable set of instructions for implementing the various processes as described herein, and one or more digital signal processors. The sound environment manager 494 can also be comprised of one or more application specific integrated circuits (ASICs) designed to implement the various processes and features as described herein. The sound environment manager includes one or more data stores that are accessible to the processing hardware referenced above. These data stores can include a mass data storage device, such as a magnetic hard drive, RAM, and/or ROM. The sound environment manager 494 can also include one or more computer busses suitable for transporting data among the various hardware and software entities which comprise the sound environment manager 494. Such computer busses can also connect the various hardware entities to data ports suitable for communicating with other parts of the BSS 400 as described herein. These data ports can include buffer circuitry, A/D converters, D/A converters and any other interface devices for facilitating communications among the various hardware entities forming the BSS 400.

The sound environment manager 494 also receives information concerning the head orientation of a user who is wearing headset 108. For example, sensor data from the head-tracking apparatus 102 can be communicated to a head orientation generator 414. The head orientation generator can be incorporated into the BSS 400 as shown or can be integrated into the head-tracking apparatus 102. In either case, data concerning the orientation of a listener's head is communicated to the sound environment manager. Such data can include pitch, roll, and yaw data. The sound environment manager 494 also receives signals from the sound field control interface 416. Sound field controller 416 advantageously includes one or more system interface controls that allow a user to select a desired audio environment or combination of environments. These controls can include hardware entities, software entities, or a combination of hardware and software entities as necessary to implement any required interface controls.

A function of the sound environment manager 494 is to manage the multiple environments that the user selectively chooses for the purpose of creating a customized audio environment. By using the sound field control interface 416, a user can cause the sound environment manager 494 to select and combine any number of audio environments. These environments include but are not limited to: selective filtering, selective relevance, alerts and warnings, intelligence infusion, navigation aid, localization enhancements, and telepresence. These environments are discussed in more detail below.

Referring again to FIG. 5, it can be observed that the head-tracking apparatus 102 provides information regarding the head rotation and position of the listener. The head tracking information is used by the sound environment manager 494 to alter the various audio filters within the audio generator 496 applied to enunciated data 602 received by the RF Receiver 492. In order to advantageously present one or more binaural environments to each user, the BSS 400 includes an audio generator 496. The audio generator 496 processes enunciated data as necessary to implement the various audio environments selected by a user. In this regard, the audio generator 496 includes digital signal processing circuitry for audio generation of enunciated data. For example, each word or sound specified by the enunciated data can require a specific set of HRTF filters 408, a set of binaural room impulse response (BRIR) filters 410, and a set of reverberation filters 412. All of these sets are then combined as necessary in the audio mixer 484. The resulting audio signal from the audio mixer 484 is communicated to the headset 108. The result is an audio signal for the left speaker 106 that may be a combination of monophonic, stereophonic, and binaural sound representing one or more sound sources as specified by the enunciated data 602 and the metadata 604. The audio signal for the right speaker 104 can similarly be a combination of monophonic, stereophonic, and binaural sound representing a combination of different sounds as specified by the enunciated data 602.

The BSS 400 advantageously includes an internal GPS generator 402. The internal GPS generator 402 is preferably physically located within each user's BSS 400. However, it could be placed anywhere on the user including a location within the head-tracking apparatus 102. The function of the internal GPS generator 402 is to provide the physical location of the listener to the sound environment manager 494. The sound environment manager formats outgoing RF signals with such GPS metadata to identify the source location of signals transmitted from each BSS 400. When such GPS metadata is communicated as part of an RF signal, it is referred to as type 1 metadata 604-1.

As noted above, the RF transceiver 492 communicates enunciated data 602 and metadata 604 to the sound environment manager 494. The sound environment manager decodes the two types of data to determine the details of the binaural audio to be presented to the user. For example, the sound environment manager will decode the enunciated data to determine specific audio information to be reproduced for a user. In this regard, it should be understood that enunciated data can include a variety of different kinds of enunciated data. For example, the enunciated data can be an encoded analog or digital representation of live audio. An example of such live audio would be human speech. Such enunciated data can originate, for example, from a BSS 400 associated with some other user. Still, it should be understood that enunciated data is not limited to human speech. Enunciated data also includes data which specifies certain tones or machine generated speech audio that is reproduced at the BSS 400. For example, such speech can be reproduced using an earcon generator 406.

In general, the term "earcon" refers to a verbal warning or instruction that is generated by a machine. Earcon generator 406 generates earcon audio in response to the enunciated data 602 as described above. The enunciated data or a decoded version of the enunciated data is provided to the earcon generator 406 by the sound environment manager 494. In response, the earcon generator 406 generates earcon audio to be presented to a user. Accordingly, it will be understood that the enunciated data 602 can indicate warnings, directions, information-of-interest, and so on. The earcon generator will respond by generating appropriate voice audio for the user. Such machine generated speech audio can also be stored in a recorded format at BSS 400. The earcon generator 406 can also be designed to generate non verbal audio signals such as warning tones.

From the foregoing description of earcon generator 406, it will be understood that enunciated data 602 need not directly contain audio data. Instead, the enunciated data 602 can merely comprise a pointer. The earcon generator 406 will utilize the pointer to determine the actual audio that is produced by the BSS 400. Such audio can be machine generated speech audio and/or tones. It is not necessary for the enunciated data 602 to in fact contain the analog or digital audio which is to be presented to the user. However, in an alternative embodiment, the enunciated data 602 can include actual audio data that is a digital or analog representation of the warning sounds or words to be reproduced by the earcon generator 406.

Enunciated data 602 will generally be accompanied by some corresponding metadata 604. This metadata 604 can be used to determine whether the earcon generator 406 should generate an earcon in the case of a particular enunciated data 602 that has been received. According to an embodiment of the invention, the sound environment manager 494 uses spatial position metadata to determine whether the user should receive a binaural earcon message. For example, the sound environment manager can calculate the distance between the source of the enunciated data 602 and the user who received the enunciated data. The sound environment manager 494 can then make a determination based on the type of warning or alarm as to whether the earcon should be generated. This determination is then sent to the earcon generator 406, or the enunciated data can simply not be sent to the earcon generator. Alternatively, the sound environment manager 494 can determine from the metadata that a particular user is not an intended or necessary recipient of the particular earcon. For example, this might occur if the user has indicated through the interface of their sound field controller 416 that they are not a member of a particular group requiring such an earcon. Type 1 metadata (exclusive of metadata indicating a spatial position) can indicate that the source of the enunciated data has indicated that the earcon is intended only for type 1 users. If a particular user is a type 2 user, then they will not receive the enunciated earcon message.

Regardless of whether the enunciated data 602 contains the actual audio information which is to be reproduced, or is merely a pointer, an audio signal is ultimately communicated to audio generator 496. The audio signal can be a digital data stream, analog audio signal, or any other representation of the enunciated data 602. Regardless of the particular form of the audio signal, audio generator 496 processes the audio signal to produce a desired binaural audio. Techniques for generating binaural audio are known in the art. Accordingly, the details of such techniques will not be discussed here in detail. However, the audio generator 496 advantageously includes HRTF filter(s) 408, BRIR filter(s) 410, and a reverb filter(s) 412. One or more of these filters are used to modify the audio signals to be presented to a user as defined by the enunciated data. In particular, the sound for each ear of a user is processed or modified based on the metadata 604 corresponding to the enunciated data 602 received.

Similarly, voice audio generated by the user of a particular BSS 400 is detected using a microphone 107. This audio is communicated to the sound environment manager. The sound environment manager will format the audio into an analog signal or a digital data stream. The signal will include metadata 604. For example the metadata 604 can include a spatial location of the particular BSS 400 as determined by the internal GPS generator 402. The signal thus generated can also include metadata generated by the internal metadata generator 404. For example, such internal metadata can be type 2 metadata 604-2 (relating to non-spatial position information). According to one aspect of the invention, the type 2 metadata specifies a group to which the user of a particular BSS 400 has been assigned. For example, the group can be a squad of soldiers.

The sound field controller 416 allows a user to specify the type of audio the user wishes to hear, and also allows the user to specify one or more virtual binaural audio environments. The audio mixer 484 can provide the listener with monophonic audio, stereophonic audio, or 3-D binaural audio. In addition, the listener can choose to have certain sound sources in binaural audio while other sound sources within the same environment to be in stereophonic audio. The BSS 400 provides the user with any number of various virtual audio environments from which to choose. Following is a brief description of some of the audio environments which can be selected and the manner in which they are advantageously used in connection with the present invention.

A. Selective Filtering Mode

Those skilled in the art will appreciate that relevant audio information can in some instances become diluted with unwanted background sounds. To reduce such dilution and thereby improve the signal-to-noise ratio, humans have an innate ability to select sounds which are of interest. This natural ability helps humans reduce or eliminate those sounds that are not needed. For example, humans by nature have the ability, to a limited degree, to focus on selected voices (or voices originating from a particular location) even though the background voices may be louder. This has been described in various papers as the "cocktail party effect".

In an embodiment of the invention, a soldier can achieve an improved understanding of battlefield conditions (situational awareness) by better understanding the locations of other soldiers in his group. For example, a military reconnaissance mission may involve four groups of soldiers, with each group going in a different direction to survey the surrounding conditions. Instead of listening to all the various conversations occurring in the communication network, each group could select their own binaural environment. Thereafter, if soldiers of one group were to spread out in a crowded urban environment and lose sight of each other, they would still be aware of each of their group member's location. Their voice communication would inform everyone in the group of their approximate location by visualizing virtual positions for the speakers. And everyone within the group would understand their positional relationship to the others in the group by simply listening to their voices. Thus, the soldiers could keep their eyes focused on their surroundings instead of on their instruments.

In the BSS 400, the foregoing feature could be implemented by utilizing type 1 metadata 604-1 and type 2 metadata 604-2 as described above. For example, the type 1 metadata can identify a particular signal transmitted by BSS 400 as originating with a user assigned to one of the predetermined groups. In this case, the type 1 metadata 604-1 would include at least one data field that is provided for identifying one of the predetermined groups to which a user has been assigned. For example, this group information can be entered into the BSS 400 by a user through the interface provided by the sound field controller 416. The metadata 604 would be inserted into the transmitted signal 600 together with the enunciated data 602. When the transmitted signal 600 is subsequently received by a BSS 400 of another user, the sound environment manager 494 will determine, based on the type 1 metadata, the group from which the transmitted signal 600 originated. If the user who transmitted the signal 600 is a member of the same group as the user who received the signal, then the sound environment manager will cause the enunciated data 602 to be reproduced for the user using binaural processing to provide a 3-D audio effect. The type 2 metadata will be used by the sound environment manager 494 to determine the correct binaural processing for the enunciated data. For example, the audio generator 496 can utilize this information so that it can be properly presented in the user's binaural environment. For example, the audio generator can use the information to cause the enunciated data to apparently originate from a desired spatial location in the virtual audio environment.

B. Selective Relevance Mode

The selective filtering techniques described above can be utilized by BSS 400 in another configuration which combines a plurality of audio dimensions such as 3-D (binaural), 2-D (stereophonic), and 1-D (monophonic). For example, in certain circumstances, a user may not want to eliminate all background audio information. However, rather than keeping the less relevant audio in the same audio dimension with their desired binaural sound sources, a user could change the less relevant audio to a monophonic (1-D) or stereophonic (2-D) dimension. The effect of changing an audio format for sounds from binaural to monophonic or stereophonic audio signifies a different level of relevancy or importance for such audio. This process also removes any localization cues for that audio. The decibel level of the 1-D, 2-D or 3-D audio can be adjusted to whatever the listener desires for that dimension.

In order to implement the foregoing effects, separate binaural audio environments can be defined for each predetermined group of users. Thereafter each BSS 400 can use received metadata to determine a group of a user from which enunciated data originated. Enunciated data received from various users within a user's predetermined group will be presented in a binaural format. In particular, the sound environment manager 494 will use the type 1 metadata 604-1 to determine if a signal originated with a member of particular group. Enunciated data originating from members of the same group will be reproduced for a user of each BSS 400 in a 3-D binaural audio environment. Each BSS 400 can process enunciated data for group members using type 2 metadata to create binaural audio to represent where members of that user's group are located.

According to a preferred embodiment, BSS 400 will also receive RF signals 600 from users associated with at least a second one of the predetermined groups of users. Such RF signals can be identified based by using type 1 metadata. The enunciated data 602 from these signals is also reproduced at headset 108 and can be audibly perceived by the user. Significantly, however, BSS 400 can be configured to reproduce such audio in a different audio format. For example, rather than reproducing such audio in a 3-D binaural format, the audio can be presented in 1-D monophonic format. Because this audio is not presented with the same audio effect, it is perceived differently by a user. The user can use this distinction to selectively focus on the voices of members of their own group.

There are various situations in which a user might benefit by combining various audio dimensions as described herein. For example a commanding officer in the previous example might wish to listen to the voices of the other three commanders, but in monophonic audio. Thus, the commander can distinguish between the binaural voices of soldiers in his group and the monophonic voices of other commanders. Furthermore, having the ability to listen to the other commanders provides the listener with important information regarding his situational awareness.

C. Alerts and Warnings

In addition to voice communication, other types of information can be superimposed into the sound field using type 1 and type 2 metadata. For example, sensor information can be detected by using one or more sensors 401. This sensor information can be integrated into a format corresponding to signal 600. This signal is then transmitted to various users 109-1, 109-2, . . . **109-*n* and received using a BSS 400 associated with each user. The sensor 401 can be any type of sensor including a sensor for biological, nuclear, or chemical hazards. Moreover, the sensor 401 is designed to broadcast a signal 600 if a hazard 403 is detected. The signal 600 will include enunciated data 602 and metadata 604 as necessary to alert users of the hazard. For example, the enunciated data will include audio data or a data pointer to a particular earcon which is to be used by BSS 400. The enunciated data can be used to communicate to a user the nature of a hazard. The metadata 604** can include type 1 metadata and type 2 metadata.

The type 2 metadata can include GPS coordinates of a sensor that detected a hazard or an estimated GPS location of the hazard as detected by the sensor. When this RF signal is received by a user's radio, the user's BSS 400 will use the type 2 metadata to determine where the sensor 401 is relative to the user, and provide the user with an earcon as specified by the enunciated data. The earcon would translate the received enunciated data to a phrase like, "chemical toxin detected, stay away!" and would be heard in the soldier's 3-D sound environment. In particular, the sound environment manager 494 will use GPS coordinates provided by the sensor 401 and GPS coordinates provided of the user (as provided by the internal GPS generator 402) to determine the direction of the hazard 403 relative to the user. The audible warning would thus alert the user that he is too close to the lethal toxin, and by listening to the 3-D binaural audio, the user would be able to ascertain a direction of the sensor 401 (and/or the associated hazard). Consequently, the user would know which direction to move away from in order to escape the affected area.

D. Intelligence Infusion

Combining intelligence information with the binaural audio environments described above could significantly augment the combat power of the front-line soldier. In the past, the problem has been too much information coming into a command center and too little relevant information going out to the soldiers on the front line in a timely manner. With the present invention, the intelligence (enunciated data 602) could be broadcasted with relevant GPS data (type 1 metadata 604-1) to specify a range of locations for users who are to receive the intelligence data. In this way, the soldiers that need the information immediately would receive it via the selective relevance mode described above. In other situations, intelligence could be broadcasted from a command center to only those soldiers that need it and would be received via the selective filtering mode as described above.

In order to better understand these features, an example is helpful. In urban warfare, sensors could be distributed throughout cities to detect various events. If a group of soldiers were to go out on a rescue mission equipped with BSS 400, the soldiers could combine two audio environments to improve their situational awareness. For example a 3-D binaural environment and a monophonic environment could be selected.

The selective filtering mode described above would be beneficial if the soldiers had to disperse due to an ambush. Every soldier would know where their friends were simply by listening to their voice communications. One or more sensors 401 could be used to detect threats, such as sniper fire. These sensors 401 could be activated by a sniper 402 located on a rooftop that has fired his weapon at the soldiers on the street. The sensors 401 would provide the spatial location of the sniper simultaneously to every soldier in the area. This is accomplished by having the sensor 401 identify the GPS location of unfriendly gunfire and thereby direct friendly fire at the sniper location. For a soldier on the street, his computer would provide an earcon which would sound as though it originated from the sniper's location in the virtual 3-D sound. The enunciated data 602 could specify an earcon saying "shoot me, shoot me!" The type 2 metadata 604-2 would include GPS information specifying a location of the sniper threat.

According to one embodiment of the invention, the sensor 401 will transmit its warning for a few seconds. If the sniper 402 was to change position and fire again, the sensor 401 would detect the new position and generate a new warning. BSS 400 would receive the warning and would detect the change in type 2 metadata 604-2. This change in metadata would cause BSS 400 to change the virtual location of the earcon in the 3-D binaural environment. Advantageously, the earcon could start out louder this time and slowly diminish over a few seconds. This would let the soldier know how long it has been since the sniper 402 last fired. In this scenario, the audio intelligence is being provided to the soldiers in real-time to warn of immediate danger in the area, thus the soldiers do not have to take their eyes off the surrounding area to look at visual instruments.

Similarly, if a wanted suspect has been discovered at a particular internet café in the city, intelligence data could be broadcasted to soldiers who happen to be located near the café to aid in capturing the suspect. The soldiers located near the café could be designated for receipt of the broadcasted message by including type 1 metadata 604-1. Such type 1 metadata would indicate that the message should be enunciated only to soldiers within a particular limited geographic area as defined by the type 1 metadata. For example, the type 1 metadata could specify a particular GPS coordinate and a predetermined distance. Each BSS 400 would then determine whether the BSS 400 was located within the predetermined distance of the particular GPS coordinates. Of course, other methods could be used to specify the geographic area. The broadcasted signal 600 would also include enunciated data 602 which directly or indirectly specifies an appropriate earcon. For example, the selected earcon communicated to all the soldiers within a few blocks of the café could be "Capture me, I'm wanted!" The soldiers would carefully move in the direction provided by the BSS 400 binaural audio environment to locate the café and capture the suspect.

E. Navigational Aid

The BSS 400 can also be used as a navigational aid. For instance, if soldiers needed to be extracted from a hostile area, a signal 600 containing information about the time and location of extraction would be received by their BSS 400. For example, this signal 600 can include enunciated data 602, type 1 metadata, and type 2 metadata to define this information. The signal 600 would be used by the BSS 400 in combination with the GPS location specified by the internal GPS generator 402. For example, this information could be used by BSS 400 to provide the soldier with three pieces of audible information. First, an earcon defined by enunciated data 602 would provide binaural audio indicating the direction of the extraction point. Next, the earcon would tell the soldier the distance remaining to the extraction point. Finally, the earcon would tell the soldier how much time is left before the extraction vehicle (e.g. helicopter) arrives. Thus, the soldiers would hear an earcon repeat, "Extraction point is two miles away. Thirty-two minutes remaining." Note that the earcon would be presented in binaural audio so that it would appear to be coming from the direction of the extraction point. The internal computer would update the audible information every few seconds, and the soldier's HRTFs would constantly be updated to guide them to the correct location.

This audible navigational environment could be combined with other audible environments to provide the soldier with additional information about his surroundings. For instance, the soldier may need to communicate with other friendly soldiers that may not be within line-of-sight but will also be headed toward the same extraction point. Every soldier could hear the approximate position of other soldiers. If a soldier is wounded and is having difficulty walking, the binaural audio system could guide a nearby soldier over to the wounded soldier to provide assistance in getting to the extraction point.

F. Localization Enhancements

Another audio dimension would be to shape the binaural sound field created by BSS 400 so as to provide the user with better localization cues. These localization cues can extend beyond simply causing the audio to apparently originate in a particular direction. According to an embodiment of the invention, BRIR filters 410 can be used to create a reverberation effect. Different virtual rooms are used to represent radial distances from a user. Using this technique, the user can better estimate how great a distance a remote signal source is relative to the user's position. For instance, distances less than 100 feet could be presented to a user without being filtered by a BRIR or the BRIR could correspond to a BRIR of a small room. For distances between 101 to 1000 feet, a BRIR filter 410 corresponding to a narrow room would be used. For distances greater than 1000 feet a BRIR filter 410 corresponding to a long narrow room would be used. Of course, the exact shape of the room and the corresponding BRIR filter is not critical to the invention. All that is necessary is that different BRIR filters be used to designate different distances between users. Thus, a group of soldiers scattered over a two mile wooded area would hear normal sound for fellow soldiers located less than 100 feet. When communicating with fellow soldiers moderately far (e.g. 101 to 1000 feet) away, the voices of such soldiers would sound as though they were originating from the far end of a narrow room. Similarly, voice transmission from soldiers who were further away, say more than 1000 feet, would sound as though they were originating from the far end of a long narrow room. Of course, all of the communications from soldiers in the group could also be presented in binaural audio. Consequently, all the soldiers would know by listening to the voices the relative direction and approximate distance between them and the speaker.

The foregoing features can be implemented in the BSS 400 using enunciated data 602, type 1 metadata 604-1 and type 2 metadata 604-2. The distance between users can be communicated using type 2 metadata. The user can select an enhanced localization mode using an interface provided by sound field controller 416. Thereafter, sound environment manager 494 will select an appropriate HRTF filter 408 and an appropriate BRIR filter 410 based on a calculated distance between a BSS 400 from which a signal 600 was transmitted and the BSS 400 where the signal was subsequently received.

G. Telepresence Mode

The telepresence mode permits a user to be virtually displaced into any environment to gain a better understanding of the activities occurring in that area. Using the telepresence mode, combat commanders would be able to more effectively understand the military operations that are occurring on any particular battlefield. Any commander could be virtually transported to the front line by programming their BSS 400 with the GPS position of any location at the battlefield. The location could be a fixed physical location or the position can move with an officer or soldier actually at the battle site. Through telepresence, the user would be able to hear the voice communications and virtual positions of all soldiers or officers relative to the selected officer. This binaural audio would complement the visual information the commander is receiving from unmanned aerial vehicles flying over the battle site. By being virtually immersed into this combat environment, the commander can make better informed decisions.

I claim:

1. A method for communicating binaural information to a user using a first Binaural Sound System (BSS) of an audio system, said method comprising:

performing user-software operations to cause said first BSS to select at least two virtual audio environments from a plurality of virtual audio environments;

generating, at said first BSS, a combined virtual audio environment based on said two virtual audio environments which were previously selected by said user;

receiving, at said first BSS, first and second signals comprising first information including enunciated data which specifies certain information intended to be audibly enunciated to said user in different virtual audio environments of said plurality of virtual audio environments, and second information including at least a first metadata comprising information which identifies a characteristic of said enunciated data exclusive of spatial position information of a source of said enunciated data; and performing operations at said first BSS to provide said combined virtual audio environment to said user which includes said enunciated data of said first and second signals in accordance with at least one predetermined audio enhancement based on said first metadata of said first and second signals;

wherein said plurality of virtual audio environments are configured to simulate different acoustic environments containing sound from select sound sources, said sound sources of at least one of said different acoustic environments selected to include members of a group of users of second BSSs of said audio system.

2. The method according to claim 1, further comprising selecting said second information to further include at least a second metadata which indicates a spatial position information of said enunciated data in said respective one of said different virtual audio environments.

3. The method according to claim 2, further comprising modifying said enunciated data with at least one of a Binaural Room Impulse Response (BRIR) filter and a reverb filter responsive to said second metadata.

4. The method according to claim 3, further comprising selecting at least one of said BRIR filter and said reverb filter in accordance with a relative spatial distance of said user with respect to a remote location associated with a source of said enunciated data.

5. The method according to claim 1, further comprising selecting said enunciated data to include at least one of digital voice data and data that specifies a predetermined earcon.

6. The method according to claim 1, wherein said predetermined audio enhancement comprises including said enunciated data in said combined virtual audio environment only if said first metadata indicates that said enunciated data is associated with a particular one of said plurality of virtual audio environments.

7. The method according to claim 1, further comprising establishing a plurality of user groups, and wherein said predetermined audio enhancement further comprises including said enunciated data in a particular one of said plurality of virtual audio environments only if said enunciated data originated with a member of a predetermined one of said user groups.

8. The method according to claim 1, wherein said predetermined audio enhancement comprises selecting an audio reproduction format based on a source of said enunciated data as specified by said first metadata.

9. The method according to claim 8, wherein said audio reproduction format is selected from the group consisting of monophonic audio, stereophonic audio, and binaural audio.

10. The method according to claim 8, further comprising defining a plurality of information relevance levels, and wherein said predetermined audio enhancement comprises selectively applying said audio reproduction format in accordance with a particular relevance level specified by said first metadata.

11. The method according to claim 8, wherein a relevance level of enunciated data is determined based on a source of said enunciated data.

12. The method according to claim 1, further comprising selecting said predetermined audio enhancement to include selectively muting said information intended to be audibly enunciated to said user.

13. The method according to claim 1, further comprising selecting said enunciated data to include live voice data as generated by a person.

14. The method according to claim 1, further comprising selecting said enunciated data to specify at least one word which is machine reproduced for a user.

15. The method according to claim 14, further comprising generating said at least one word using stored audio data responsive to said enunciated data.

16. The method according to claim 1, further comprising selecting said enunciated data to specify at least one tone which is audibly reproduced for a user.

17. The method according to claim 1, further comprising automatically generating at least one of said first signal and second signal responsive to a control signal specifying the occurrence of a predetermined condition.

18. The method according to claim 17, further comprising automatically generating said control signal in response to a sensor disposed within an environment.

19. A binaural sound system for communicating binaural information to a user, comprising:

a receiver configured for receiving at least first and second signals containing at least;

first information comprising enunciated data which specifies certain information intended to be audibly enunciated to said user in different virtual audio environments of a plurality of audio environments, and second information comprising first metadata and second metadata, said first metadata comprising information which identifies a characteristic of said enunciated data exclusive of spatial position information of a source of said enunciated data, and at least a second metadata which identifies a spatial position information associated with said source of said enunciated data;

an audio processing system responsive to an RF signal, said audio processing system configured for generating a combined virtual audio environment based on at least two virtual audio environments from said plurality of audio environments which were previously selected by said user, and for audibly reproducing said enunciated data of said first and second signals in said combined virtual audio environment and in accordance with at least one predetermined audio enhancement based on said first metadata of said first and second signals;

wherein said plurality of virtual audio environments are configured to simulate different acoustic environments containing sound from select sound sources, said sound sources for at least one of said different acoustic environments selected to include members of a group of users of a plurality of binaural sound systems.

20. The system according to claim 19, wherein said second information further includes at least a second metadata which indicates a spatial position information of said enunciated data in said respective one of said different virtual audio environments.

21. The system according to claim 20, wherein said binaural sound system is configured to modify said enunciated data with at least one of a Binaural Room Impulse Response (BRIR) filter and a reverb filter responsive to said second metadata.

22. The system according to claim 21, wherein said binaural sound system is configured to selectively apply said BRIR filter and said reverb filter in accordance with a relative spatial distance of said user with respect to a remote location associated with a source of said enunciated data.

23. The system according to claim 19, wherein said enunciated data includes at least one of digital voice data and data that specifies a predetermined earcon.

24. The system according to claim 19, wherein said first metadata specifies one of said plurality of virtual audio environments.

25. The system according to claim 24, wherein said binaural sound system is configured to include said enunciated data in said combined virtual audio environment only if said first metadata indicates that said enunciated data is associated with a particular one of said plurality of virtual audio environments.

26. The system according to claim 24, wherein said binaural sound system is configured to include said enunciated data in a particular one of said plurality of virtual audio environments only if said first metadata indicates that the enunciated data originated with a member of a predetermined one of a plurality of user groups.

27. The system according to claim 24, wherein said binaural sound system is configured to select an audio reproduction format based on a source of said enunciated data as specified by said first metadata.

28. The system according to claim 27, wherein said audio reproduction format is selected from the group consisting of monophonic audio, stereophonic audio, and binaural audio.

29. The system according to claim 28, wherein said binaural sound system is configured to selectively apply said audio reproduction format in accordance with a particular relevance level specified by said first metadata.

30. The system according to claim 29, wherein a relevance level of enunciated data is determined based on a source of said enunciated data.

* * * * *